US005356319A

United States Patent [19]

Parker

[11] Patent Number: 5,356,319

[45] Date of Patent: Oct. 18, 1994

[54] BOAT WITH REMOVABLE INBOARD JET PROPULSION UNIT

[76] Inventor: Corvin L. Parker, P.O. Box 2056, Jupiter, Fla. 33468

[21] Appl. No.: 6,977

[22] Filed: Jan. 21, 1993

[51] Int. Cl.[5] ..... B63H 11/00

[52] U.S. Cl. ..... 440/38; 440/76; 440/111; 440/112

[58] Field of Search ..... 440/38, 111, 112, 76, 440/900; 114/345

[56] References Cited

U.S. PATENT DOCUMENTS

| | | | |
|---|---|---|---|
| 2,633,817 | 4/1953 | Pedranti | 440/112 |
| 3,194,205 | 7/1965 | Mattson et al. | 440/38 |
| 3,223,067 | 12/1965 | Horan | 440/112 |
| 3,324,821 | 6/1967 | Laughlin | 440/2 |
| 4,226,206 | 10/1980 | Wilson | 440/112 |
| 4,236,478 | 12/1980 | Mannson | 440/112 |
| 4,543,069 | 9/1985 | Kobayashi | 440/112 |
| 4,942,838 | 7/1990 | Boyer et al. | 440/38 |

FOREIGN PATENT DOCUMENTS

| | | | |
|---|---|---|---|
| 2017747 | 1/1972 | Fed. Rep. of Germany | 114/345 |
| 2032871 | 5/1980 | United Kingdom | 114/345 |

*Primary Examiner*—Michael S. Huppert
*Assistant Examiner*—Thomas J. Brahan
*Attorney, Agent, or Firm*—Alvin S. Blum

[57] ABSTRACT

A boat is provided with an integral jet power unit encased in a waterproof housing. The hull has a well or compartment open at top and bottom which removably receives the power unit. Retaining elements hold the power unit in place in the compartment. Resilient gasket seals the housing in the well, reduces transmission of vibration and cushions the thrust generated by the jet. The walls of the well are sealed to the bottom of the boat hull so that the hull will not leak when the power unit is removed. The invention may be embodied in various hull constructions including folding and inflatable boats, where handling the hull and power unit separately greatly enhances operation, transport and storage.

17 Claims, 1 Drawing Sheet

FIG. 1
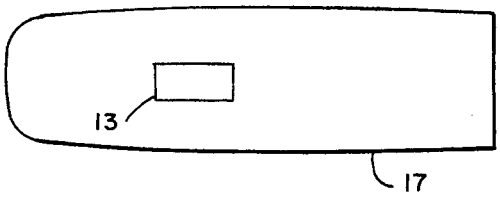
FIG. 3
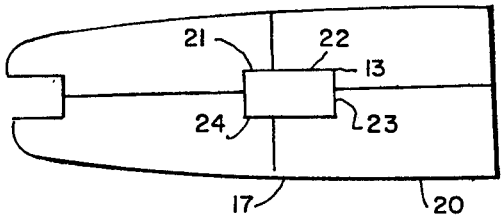
FIG. 2
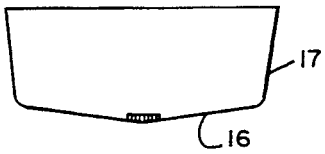
FIG. 4
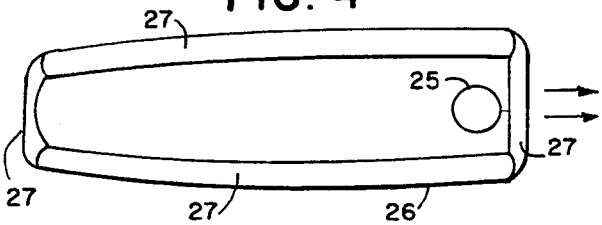
FIG. 5
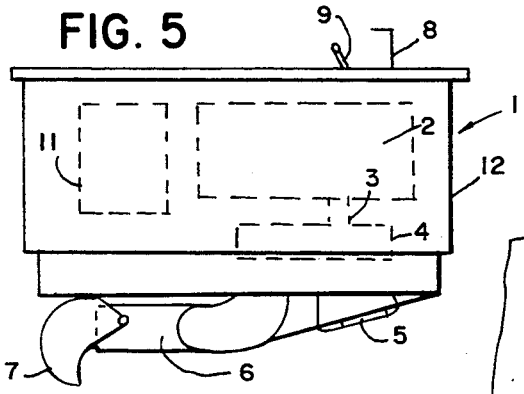
FIG. 8
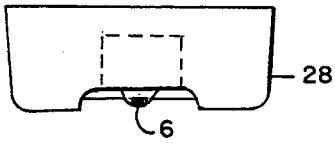
FIG. 6
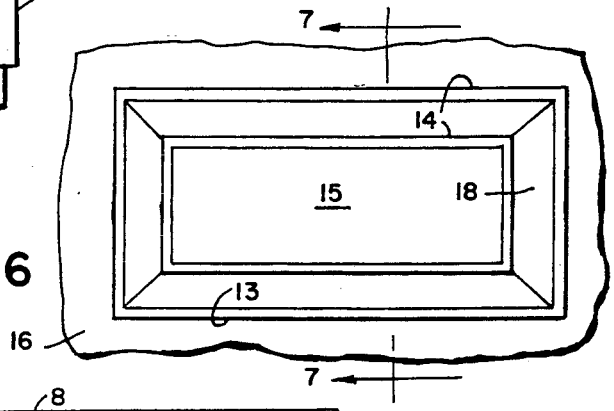
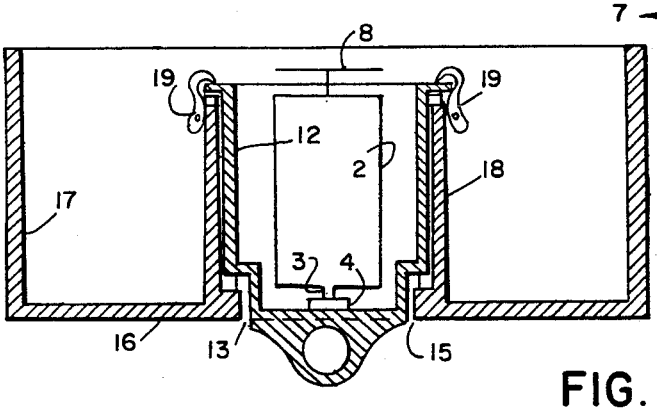
FIG. 7

BOAT WITH REMOVABLE INBOARD JET PROPULSION UNIT

BACKGROUND OF THE INVENTION

This invention relates to bests and more particularly to a boat propelled by an inboard jet in which the jet unit is readily installed and removed for easier boat transport and storage.

Jet units are a favored propulsion means for small vessels for their high speed, shallow draft and freedom from dangerous propellers. They are popular for the small jet ski boats. U.S. Pat. No. 4,942,838 issued Jul. 24, 1990 to Boyer et al. and U.S. Pat. No. 4,964,821 issued Oct. 23, 1990 to Tafoya disclose larger boats with jet power that have a rigid bottom to which the power unit is fixed and inflatable pontoon sides. Even when deflated, this is a large and heavy package to transport and store. The power unit is easily damaged if a leak occurs in the flimsy hull structure. Furthermore, the vibration and thrusts from the power unit must be taken up by the weak hull structure, which may fail and leak.

The applicant has invented a folding boat structure disclosed in U.S. patent application Ser. No. 835,353 filed Feb. 14, 1992. This structure might be favorably powered by a jet, but it would not be practical with inboard jets of the prior art because it would be too heavy and awkward to fold up. This is the case also with other inflatable, folding and portable boats. An outboard jet engine such as described in U.S. Pat. No. 4,459,117 issued Jul. 10, 1984 to Jordan is arranged to clamp onto the transom. This puts great stress on the transom and puts all of the weight at the far end of the boat. It also interferes with some uses for the boat.

SUMMARY OF THE INVENTION

It is accordingly an object of the invention to provide a portable boat with an inboard jet propulsion unit in which the propulsion unit is readily installed and removed so that the boat may be folded or deflated and carried separately from the propulsion unit. It is another object that the water tightness of the propulsion unit is independent of the water tightness of the boat. It is yet another object that the propulsion unit transmit thrust through more than just the transom.

The jet propulsion unit of the invention includes a motor, an impeller, water intake, and water outlet nozzle all contained in one integral, water-tight unit. The boat of the invention includes a well or compartment having water tight vertical walls, and open at top and bottom to receive the power unit therein. Securing means hold the propulsion unit firmly in place. Resilient gasket means are provided between the power unit and the walls of the compartment to provide a snug cushioned contact therebetween for smooth, vibration-free transmission of thrust to the boat in both forward and reverse. The gasketing also prevents water from rushing up into the boat at high speeds.

These and other objects, advantages and features of the invention will become more apparent when the detailed description is studied in conjunction with the drawings, in which:

BRIEF DESCRIPTION OF THE DRAWINGS

FIG. 1 is a top view of a boat of the invention with a forward power unit.

FIG. 2 is a rear elevation view of the boat of FIG. 1.

FIG. 3 is a top view of a folding boat of the invention with a central power unit.

FIG. 4 is a top view of an inflatable boat of the invention with a stern power unit.

FIG. 5 is a side elevation view of the jet power unit of the invention.

FIG. 6 is a top perspective view of the power unit chamber portion of FIG. 1, with power unit removed.

FIG. 7 is a sectional view, taken through line 7—7 of FIG. 6, with power unit housing in place.

FIG. 8 is a rear elevation view of another embodiment of the invention.

DETAILED DESCRIPTION OF PREFERRED EMBODIMENTS

Referring now first to FIGS. 5, 6, 7, an integral jet power unit 1 includes an internal combustion engine 2 driving a shaft 3 which drives a water impeller 4. A screened water intake 5 feeds water to the impeller and a water outlet 6 from the impeller provides a thrust by a jet of water. This may be steerable and provided with a reversing cup 7 with controls for steering 8 and reversing 9 in a convention manner well known in the art. Battery 10 and gas tank 11 may also be included and all contained in water-tight housing 12. The lower end 13 of the housing has the intake and outlet jet sealing to it so that they extend into the water when the power unit is installed in the boat. The integral unit 1 fits into the well or compartment 13 with resilient gasket 14 forming a water-tight seal between the housing 12 and The well 13. This seal keeps water from being forced up into the space between housing 12 and well 13 when the boat is underway. It also creates a vibration barrier and keeps a snug fit between the bottom of the housing and the well. This is the site of the maximum thrust generated at the front of the well in forward motion and at the rear of the well in reverse. If this were a loose, rattling fit, the vibrations and sudden forces generated by the jet unit could easily destroy the light hull .construction of portable boats.

The well or compartment comprises an aperture 15 in the bottom 16 of boat hull 17. Sealed water-tight to the edges of the aperture are upstanding walls 18 which define and enclose the well, which is open at the top to receive the jet power unit. The aperture at the bottom of the well permits passage of the lower portion of the unit so that the jet outlet and the water inlet are in the water. Retaining clamps 19 fix the jet power unit in place. A variety of retaining means well known in the art may be employed for this purpose. To remove the power unit, the clamps 19 are released and the entire power unit is lifted out. The procedure is reversed to install the power unit. This may be done while the boat is in the water without danger of sinking.

The boat without the power unit is more easily transported, stored, deflated, folded or the like. FIGS. 1, 2, 6, 7 show a rigid hull with a rectangular well 13 positioned forward in the boat. FIG. 3 shows a folding boat 20 of the type disclosed in Applicant's copending patent application Ser. No. 835,353 filed Feb. 14, 1992. The well 13 is positioned in the center of the hull. It is formed by individual portions 21, 22, 23, 24 in individual portions of the hull which combine to form the complete well when unfolded.

FIG. 4 shows a cylindrical well 25 located at the rear of the boat 26 which is of the inflatable type with inflatable pontoons 27.

FIG. 8 is a rear elevation view of tunnel bottom or catamaran boat hull 28 of the invention.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A boat with a removable inboard jet propulsion unit, the boat comprising:

A) an integral jet propulsion unit including:

1) an engine;

2) a water impeller operatively connected to, and driven by, said engine;

3) a water intake to said impeller;

4) a water outlet from said impeller providing a jet of water to drive said boat;

5) a water-tight housing enclosing said engine on the sides thereof, said housing having a lower portion connected to said water intake and said water outlet;

B) a boat having a bottom portion;

C) an aperture in said bottom portion adapted for passage therethrough of said lower portion to position said intake and outlet below said aperture;

D) wall means sealingly connected to said bottom portion at said aperture in water-tight connection therewith, and extending upward therefrom, said wall means completely enclosing and defining a compartment open at top and bottom, said wall means being sufficiently high to prevent water from entering said boat when said jet propulsion unit is absent, said compartment adapted to removably receive therein said entire water-tight housing and said engine, said water-tight housing and compartment having a closed construction to prevent fore and aft movement of said housing relative to said compartment when said housing is retained in said compartment for transmission of thrust from said propulsion unit to said hull without damage; and E) releasable retaining means holding said water-tight housing operative position in said compartment with said water intake and water outlet below said bottom portion.

2. The boat according to claim 1, further comprising resilient gasket means removably sealing said compartment to said housing to prevent the passage of water therebetween and for isolation of vibration.

3. The boat according to claim 2, said gasket means providing resilient transmission of thrust in both fore and aft propulsion.

4. The boat according to claim 3 having inflatable portions for enhanced storage and transport.

5. The boat according to claim 3 having folding portions for enhanced storage and transport.

6. The boat according to claim 3 having a tunnel bottom configuration.

7. The boat according to claim 3 having a catamaran configuration.

8. The boat according to claim 3, in which said compartment has a generally rectangular shape.

9. The boat according to claim 3, in which said compartment has a generally cylindrical shape.

10. The boat according to claim 3, in which said water-tight housing prevents water from entering said engine while said propulsion unit is being inserted into or removed from said compartment while said boat is floating on water.

11. The boat according to claim 10, in which said integral jet propulsion unit is installed or removed from said compartment by straight vertical translatory motion.

12. The boat according to claim 1 having inflatable portions for enhanced storage and transport.

13. The boat according to claim 1 having folding portions for enhanced storage and transport.

14. The boat according to claim i having a tunnel bottom configuration.

15. The boat according to claim 1 having a catamaran configuration.

16. The boat according to claim 1, in which said compartment has a generally rectangular shape.

17. The boat according to claim 1, in which said compartment has a generally cylindrical shape.

* * * * *